US011039727B2

(12) United States Patent
Zhang

(10) Patent No.: US 11,039,727 B2
(45) Date of Patent: Jun. 22, 2021

(54) WASHING BASIN FOR WASHING ROLLER-TYPE MOPS

(71) Applicant: SHENZHEN NO DOUBT TECHNOLGY CO., LTD., Shenzhen (CN)

(72) Inventor: Yong Zhang, Shenzhen (CN)

(73) Assignee: Shenzhen No Doubt Technology Co., LTD., Shenzhen (CN)

( * ) Notice: Subject to any disclaimer, the term of this patent is extended or adjusted under 35 U.S.C. 154(b) by 0 days.

(21) Appl. No.: 16/603,553

(22) PCT Filed: Apr. 18, 2018

(86) PCT No.: PCT/CN2018/083541
§ 371 (c)(1),
(2) Date: Oct. 7, 2019

(87) PCT Pub. No.: WO2018/210092
PCT Pub. Date: Nov. 22, 2018

(65) Prior Publication Data

US 2020/0107693 A1 Apr. 9, 2020

(30) Foreign Application Priority Data

May 19, 2017 (CN) ..... 201720560400.7

(51) Int. Cl.

| | |
|---|---|
| ***B08B 3/14*** | (2006.01) |
| ***B08B 3/04*** | (2006.01) |
| ***A47L 13/50*** | (2006.01) |
| ***B08B 3/10*** | (2006.01) |
| ***E03C 1/18*** | (2006.01) |
| ***E03C 1/264*** | (2006.01) |
| ***A47L 13/58*** | (2006.01) |

(52) U.S. Cl.
CPC ..... *A47L 13/58* (2013.01); *A47L 13/50* (2013.01); *B08B 3/04* (2013.01); *B08B 3/10* (2013.01);
(Continued)

(58) Field of Classification Search
CPC . A47L 13/50; A47L 13/58; B08B 3/04; B08B 3/044; B08B 3/048; B08B 3/08;
(Continued)

(56) References Cited

U.S. PATENT DOCUMENTS 2,989,965 A * 6/1961 Rod ..... A47L 23/263 134/46
2,994,329 A * 8/1961 Catlin ..... A46B 17/06 134/58 R
(Continued)

FOREIGN PATENT DOCUMENTS

CN 2240955 Y 11/1996
CN 202143617 U 2/2012
(Continued)

*Primary Examiner* — Mark Spisich
(74) *Attorney, Agent, or Firm* — Robert L. Stearns; Dickinson Wright, PLLC

(57) ABSTRACT

A washing basin for washing a roller-type mop, which comprises a basin body having a washing chamber and an drainage chamber located one over the other, and the washing chamber is open upwardly for receiving the roller-type mop to be washed, the washing chamber is connected to an external water source through an inlet electromagnetic valve, the drainage chamber is connected with an external drainpipe through an outlet electromagnetic valve; and a waste filter screen which is provided between the washing chamber and the drainage chamber, and the inlet electromagnetic valve and the outlet electromagnetic valve are controlled via a control circuit.

8 Claims, 4 Drawing Sheets

(52) U.S. Cl.
CPC ..... *B08B 3/14* (2013.01); *E03C 1/18* (2013.01); *E03C 1/264* (2013.01)

(58) Field of Classification Search
CPC ..... B08B 3/10; B08B 3/14; E03C 1/07; E03C 1/18; E03C 1/26; E03C 1/264; B01D 29/05; B01D 29/60; B01D 29/605; B01D 29/66; B01D 35/02
USPC ..... 15/257.01, 260, 264; 134/56 R, 57 R, 134/104.4, 110; 4/623, 650, 652.653; 210/86, 257.1, 499
See application file for complete search history.

(56) References Cited

U.S. PATENT DOCUMENTS 3,072,935 A * 1/1963 Ruby ..... A47L 13/50 15/4
3,916,470 A * 11/1975 May ..... A47L 13/58 15/98
2005/0126611 A1* 6/2005 Eichhorn ..... B08B 3/14 134/111
2012/0222226 A1 9/2012 Chen
2012/0260948 A1* 10/2012 Balas ..... A47L 11/4022 134/21
2013/0047332 A1* 2/2013 Mirabito ..... E03C 1/055 4/650
2014/0263104 A1* 9/2014 Kepner ..... A47L 13/58 210/791

FOREIGN PATENT DOCUMENTS

CN 203138415 U 8/2013
CN 203182856 U 9/2013
CN 203873708 U 10/2014
CN 204562052 U 8/2015
CN 107007213 A 8/2017
JP 64-52092 * 2/1989

* cited by examiner

WASHING BASIN FOR WASHING ROLLER-TYPE MOPS

CROSS-REFERENCE TO RELATED APPLICATION

This application is a 35 U.S.C.§ 371 national stage application of PCT Application Serial No. PCT/CN2018/083541 filed on Apr. 18, 2018, which claims priority to Chinese Patent Application Ser. Nos. CN201720560400.7, filed on May 19, 2017, the content of each are hereby incorporated by reference in their entireties.

TECHNICAL FIELD

The present disclosure relates to mop devices, and more particularly to a washing basin capable of automatically washing a roller-type mop.

BACKGROUND

It is known that the mop is an important washing tool. The prior roller-type mop has advantages of good washing effect and low labor intensity thereof, but the washing of the roller is quite inconvenience. The prior roller-type mop carries water tanks to respectively hold clean water and sewage, and a washing device is provided on a side of the roller so as to clean the roller. However, this type of mop has a large weight and is very cumbersome to use. Therefore, there is an urgent demand to design a washing basin capable of automatically clean the roller-type mop.

SUMMARY OF INVENTION

The general object of the present disclosure is to overcome the technical issues in the prior mops, and to provide a washing basin capable of automatically clean the roller-type mop.

To solve the technical issues set forth, the present disclosure provides a washing basin for washing the roller-type mop, which comprises: a basin body having a washing chamber and an drainage chamber located one over the other, the washing chamber is open upwardly for receiving the roller-type mop to be washed, the washing chamber is connected to connected to the external water source through an inlet electromagnetic valve, the drainage chamber is connected with an external drainpipe through an outlet electromagnetic valve; and a waste filter screen being provided between the washing chamber and the drainage chamber, wherein the inlet electromagnetic valve and the outlet electromagnetic valve are controlled via a control circuit.

A water level sensor connecting the control circuit is disposed on a side wall of the washing chamber, and the inlet electromagnetic valve is controlled to be closed via the control circuit, when the water level sensor senses that water is in place.

An overflow chamber is disposed at one side of the basin body, the side wall of the washing chamber has an overflow port for connecting the overflow chamber, and the overflow chamber is connected with the external drainpipe.

One side of a bottom plate of the washing chamber sinks downward, and the waste filter screen is disposed inside.

The bottom plate of the washing chamber is inclined downward toward one side of the waste filter screen, and the middle portion of the bottom plate is provided with a water-flowing groove facing the waste filter screen, and a top sheet is erected in the water-flowing groove.

At least one flushing pipe is erected on the bottom of the washing chamber, and the inlet end of the flushing pipe is connected with the inlet electromagnetic valve.

One side of the basin body is erected with a support column for supporting the roller-type mop, the support column is provided with a socket for inserting the roller-type mop pull rod hook, and a signal spring piece and a charging elastic piece to which the roller-type mop can be coupled.

The present application uses tap water to clean the roller-type mop and the waste bin thereof, the washing efficiency is high, energy saving, easy to operate, and does not need to soil the operator's hands and feet; at the same time, the defect of self-contained water tanks of the prior roller-type mop is eliminated, and the weight of the prior roller is greatly reduced, as such the roller-type mop is easy to use.

DETAILED DESCRIPTION

In order to make the objectives, technical solutions and advantages of the disclosure more comprehensible, the disclosure is further described in detail below with reference to the accompanying drawings and embodiments. It is understood that the specific embodiments described herein are merely illustrative of the present application and are not intended to limit the present application.

Figure 1:
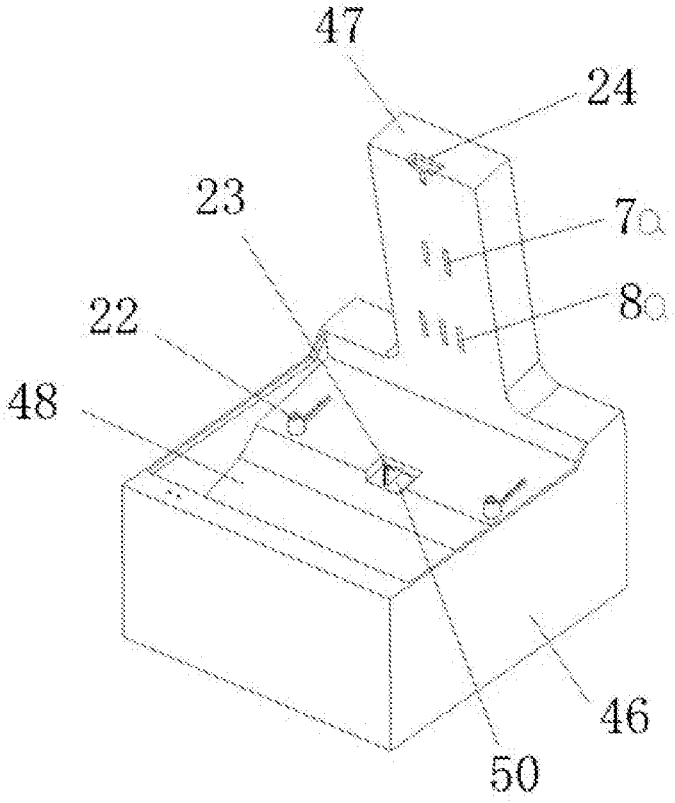
FIG. 1 is a perspective view illustrating the front of the washing basin according to the present application.
Figure 2:
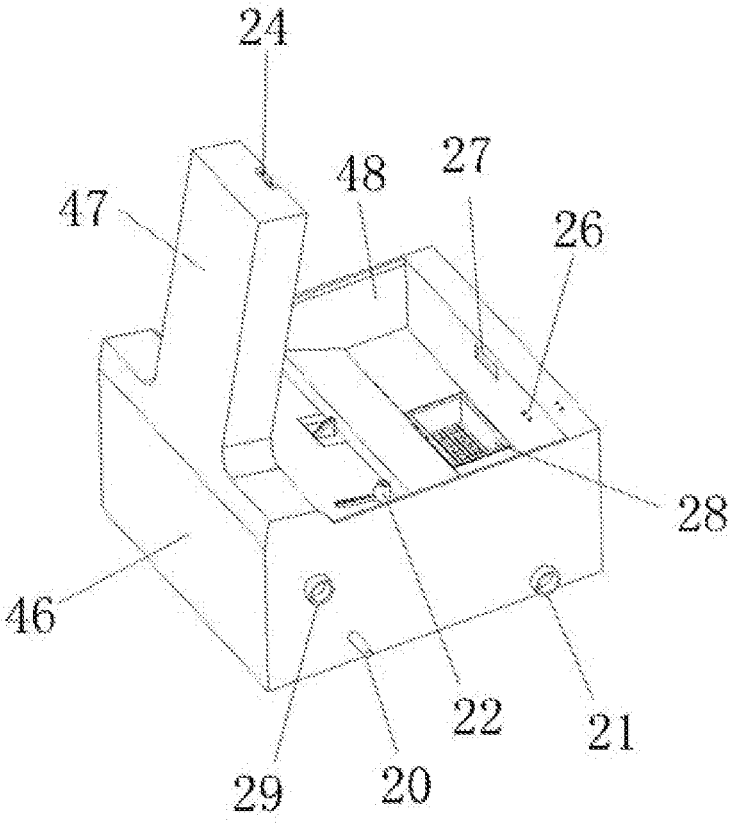
FIG. 2 is a perspective view illustrating the rear of the washing basin according to the present application.
Figure 3:
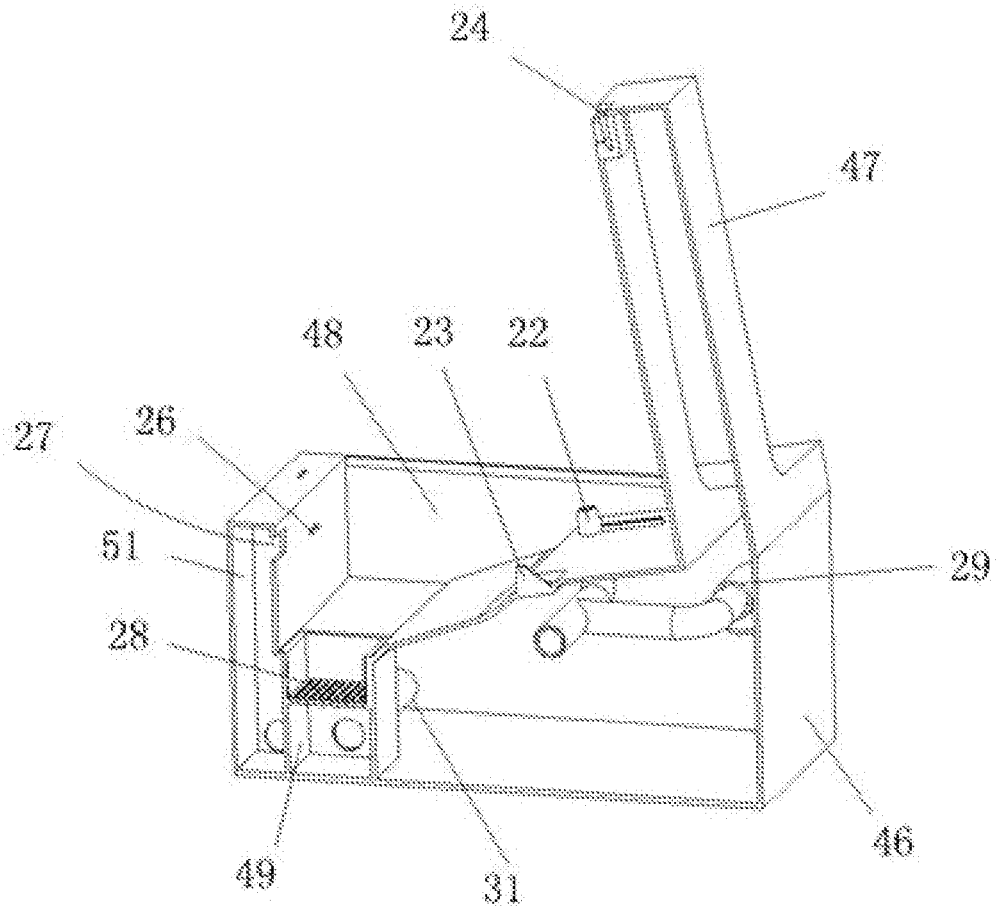
FIG. 3 is a cross-sectional view illustrating the washing basin according to the present application.

The present application discloses a washing basin for washing a roller-type mop, with reference to the front perspective view, the rear perspective view and the cross-sectional view of a preferred embodiment respectively shown in FIGS. 1 to 3, the washing basin has a basin body 46, and the basin body is provided with a washing chamber 48 and an drainage chamber 49 located one over the other, and the washing chamber is open upwardly for receiving the roller-type mop 41 to be washed. The washing chamber is connected to connected to the external water source through an inlet electromagnetic valve 29, and the drainage chamber is connected with the external drainpipe through an outlet electromagnetic valve 31. A waste filter screen 28 is provided between the washing chamber and the drainage chamber, and the inlet electromagnetic valve and the outlet electromagnetic valve are controlled via a control circuit.

Figure 4:
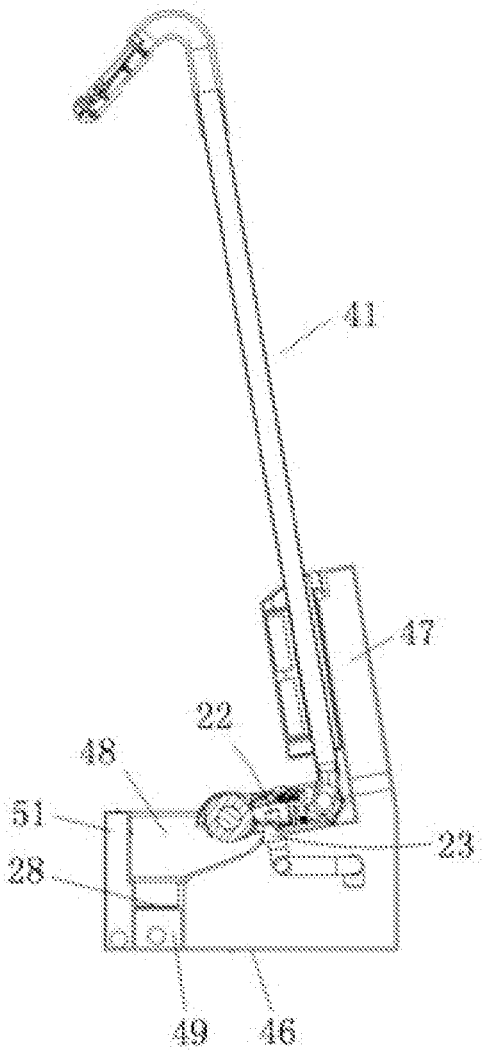
FIG. 4 is a schematic view illustrating the washing basin washing the roller-type mop according to the present application.

Referring to FIG. 4 shown a use schematic diagram, the roller-type mop 41 is placed in the washing basin, the user presses the washing button, the inlet electromagnetic valve 29 is controlled to be opened via the control circuit and then the outlet electromagnetic valve 31 activates, and the roller-type mop is flushed with the flowing water; and the roller needs to be corresponded to rotate during washing to clean up the roller.

Referring to the preferred embodiment illustrated in FIGS. 2 and 3, a water level sensor 26 is provided on a side wall of the washing chamber to which the control circuit is coupled. The inlet electromagnetic valve 29 is controlled to be closed via the control circuit when the water level sensor senses that water is in place. This structure is aimed for water conservation. When washing starts, the inlet electromagnetic valve 29 is controller to be opened via the control circuit and the outlet electromagnetic valve 31 is closed, and water is injected into the washing chamber. Once the water level reaches a position where the water level sensor positioned, the inlet electromagnetic valve 29 is controlled to be closed, and the roller is cleaned by the water in the washing chamber. At this time, the roller also to be corresponded to rotate during washing. After the washing is completed, the outlet electromagnetic valve 31 is controlled to be opened so as to discharge the sewage.

Referring to the preferred embodiment shown in FIG. 3 and FIG. 4, one side of the basin body 46 is provided with an overflow chamber 51, and an overflow port 27 connecting the overflow chamber is formed on the side wall of the washing chamber 48, and the overflow chamber is connected with the external sewer pipe. During operation, the water level in the washing chamber can be limited to prevent water from escaping from the upper edge of the basin body which may make the floor dirty. An outlet end of the inlet electromagnetic valve 29 may be connected to the overflow chamber, and the outlet port 21 as shown in FIG. 2 is connect with the external drainpipe.

As can be seen from FIG. 1 to FIG. 4, in the preferred embodiment, one side of bottom plate of the washing chamber sinks downward, and a waste filter screen 28 is disposed inside. The bottom plate of the washing chamber is inclined downward toward the side where the waste filter screen 28 positioned. The middle portion of the bottom plate is provided with a water-flowing groove 50 facing the waste filter screen, and a top sheet 23 is erected in the water-flowing groove. This structure is for tilting the roller-type mop 41, and the roller is immersed in the water as much as possible, and at the same time, there is a large slope difference between the roller and the waste net 28, so that the waste in the waste bin beside the roller and in the roller can be cleaned up. At least one flushing pipe 22 is erected on the bottom of the washing chamber, and an inlet end of the flushing pipe is connected with the inlet electromagnetic valve 29. The top sheet 23 may open the flap door at the bottom of the roller-type mop bin such that the washing pipe can get into the inside of the roller-type mop, and rinse the roller and the waste bin to achieve an effect of deep washing.

In a preferred embodiment, a side of the basin body 46 is erected with a support post 47 for supporting the roller-type mop, the support post is provided with a socket 24 for inserting the roller-type mop pull rod hook, and a signal spring piece 8*a* and a charging elastic piece 7*a* that can be connected to the roller-type mop. It should be noted that the control circuit can be disposed in the basin body, and the washing button is disposed on the outer wall of the basin body. The washing button can be pressed to start washing after the roller-type mop is placed in the washing chamber 48, the timing at which the inlet electromagnetic valve 29 or the outlet electromagnetic valve 31 is controlled to be opened or closed by the control circuit. The control circuit and the washing button may also be disposed in the roller-type mop. As the roller-type mop is inserted on the support column 47, the water level sensor, the inlet electromagnetic valve and the outlet electromagnetic valve are connected with the control circuit through the signal spring 8*a*; That is, only when the roller-type mop 41 is inserted into the support column, the inlet electromagnetic valve 29 and the outlet electromagnetic valve 31 can be controlled to be opened or closed by the control circuit on the roller-type mop for washing. In the preferred embodiment, the mains power cord (reference sign 20 in FIG. 2) is attached to the side wall of the basin body, and the power source can charge the roller-type mop via the charging elastic piece 7*a*. The power adapter may be installed inside of the basin body of the washing basin or outside the basin body.

The foregoing descriptions are merely preferred embodiments of the disclosure and are not intended to limit the disclosure. Any modifications, equivalent substitutions and improvements etc. made within the spirit and principles of the disclosure of the present application should be understood as being included within the protection scope of the present application.

What is claimed is:

1. A washing basin for washing a roller-type mop, comprising:

a basin body having a washing chamber and an drainage chamber located one over the other, wherein the washing chamber is open upwardly for receiving the roller-type mop to be washed, the washing chamber is connected to an external water source through an inlet electromagnetic valve, the drainage chamber is connected with an external drainpipe through an outlet electromagnetic valve; and a waste filter screen being provided between the washing chamber and the drainage chamber, wherein the inlet electromagnetic valve and the outlet electromagnetic valve are controlled by a control circuit;

wherein a water level sensor connecting the control circuit is disposed on a side wall of the washing chamber, and the inlet electromagnetic valve is controlled to be closed via the control circuit, when the water level sensor senses that water is in place;

wherein an overflow chamber is disposed at a side of the basin body, an overflow port connecting the overflow chamber is provided on the side wall of the washing chamber, and the overflow chamber is connected with the external drainpipe;

wherein one side of a bottom plate of the washing chamber sinks downward, and the waste filter screen is disposed inside; and wherein the bottom plate of the washing chamber is inclined downward toward one side of the waste filter screen, and a water-flowing groove facing the waste filter screen is disposed at the middle portion of the bottom plate, and a top sheet is erected in the water-flowing groove.

2. The washing basin for washing a roller-type mop according to claim 1, wherein at least one flushing pipe is erected on the bottom of the washing chamber, and the inlet end of the flushing pipe is connected with the inlet electromagnetic valve.

3. A washing basin for washing a roller-type mop, comprising:

a basin body having a washing chamber and an drainage chamber located one over the other, wherein the washing chamber is open upwardly for receiving the roller-type mop to be washed, the washing chamber is connected to an external water source through an inlet electromagnetic valve, the drainage chamber is connected with an external drainpipe through an outlet electromagnetic valve; and a waste filter screen being provided between the washing chamber and the drainage chamber, wherein the inlet electromagnetic valve and the outlet electromagnetic valve are controlled by a control circuit;

wherein one side of the basin body is erected with a support column for supporting the roller-type mop, the support column is provided with a socket for inserting the roller-type mop pull rod hook, and a signal spring piece and a charging elastic piece to which the roller-type mop can be coupled.

4. The washing basin for washing a roller-type mop according to claim 3, wherein a water level sensor connecting the control circuit is disposed on a side wall of the washing chamber, and the inlet electromagnetic valve is controlled to be closed via the control circuit, when the water level sensor senses that water is in place.

5. The washing basin for washing a roller-type mop according to claim 4, wherein an overflow chamber is disposed at a side of the basin body, an overflow port connecting the overflow chamber is provided on the side wall of the washing chamber, and the overflow chamber is connected with the external drainpipe.

6. The washing basin for washing a roller-type mop according to claim 5, wherein one side of a bottom plate of the washing chamber sinks downward, and the waste filter screen is disposed inside.

7. The washing basin for washing a roller-type mop according to claim 6, wherein the bottom plate of the washing chamber is inclined downward toward one side of the waste filter screen, and a water-flowing groove facing the waste filter screen is disposed at the middle portion of the bottom plate, and a top sheet is erected in the water-flowing groove.

8. The washing basin for washing a roller-type mop according to claim 7, wherein at least one flushing pipe is erected on the bottom of the washing chamber, and the inlet end of the flushing pipe is connected with the inlet electromagnetic valve.

* * * * *